United States Patent [19]

Tribert

[11] Patent Number: 4,646,509

[45] Date of Patent: Mar. 3, 1987

[54] METHOD AND APPARATUS FOR PACKING ELONGATED FOOD MATERIAL SUCH AS PICKLE SPEARS

[75] Inventor: Claude Tribert, Bedminister, N.J.

[73] Assignee: Northeast Ohio Axle, Inc., Lawrenceville, N.J.

[21] Appl. No.: 730,760

[22] Filed: May 3, 1985

[51] Int. Cl.[4] ..... B65B 63/00; B65B 35/56

[52] U.S. Cl. ..... 53/446; 53/236; 53/244; 53/258; 53/260; 53/473; 53/515; 53/544

[58] Field of Search ..... 53/142, 143, 236, 239, 53/244, 255, 258, 260, 263, 435, 446, 473, 514, 515, 544

[56] References Cited

U.S. PATENT DOCUMENTS

| | | | |
|---|---|---|---|
| Re. 27,852 | 12/1973 | Eisenberg | 53/515 |
| 2,775,268 | 12/1956 | Eckart | 53/255 X |
| 3,461,646 | 8/1969 | Lane et al. | 53/515 |
| 3,468,098 | 9/1969 | Eisenberg | 53/515 |

*Primary Examiner*—E. R. Kazenske
*Assistant Examiner*—Michael D. Folkerts
*Attorney, Agent, or Firm*—Kenyon & Kenyon

[57] ABSTRACT

A method and apparatus for packing into a jar elongated articles, such as cucumbers or pickles cut along their length into spears. The jar is positioned with a guide disposed within the interior of the jar. The guide directs a predetermined array of spaced spears into the jar and outwardly towards the wall of the jar. Thereafter, the jar is rotated. The guide, which is coupled to the bottom of the jar, is thereby rotated to position the guide to direct additional arrays of spears between the spears of the array previously placed in the jar.

25 Claims, 20 Drawing Figures

24
25
19
22a
22
21
23
A
20
60
B
99

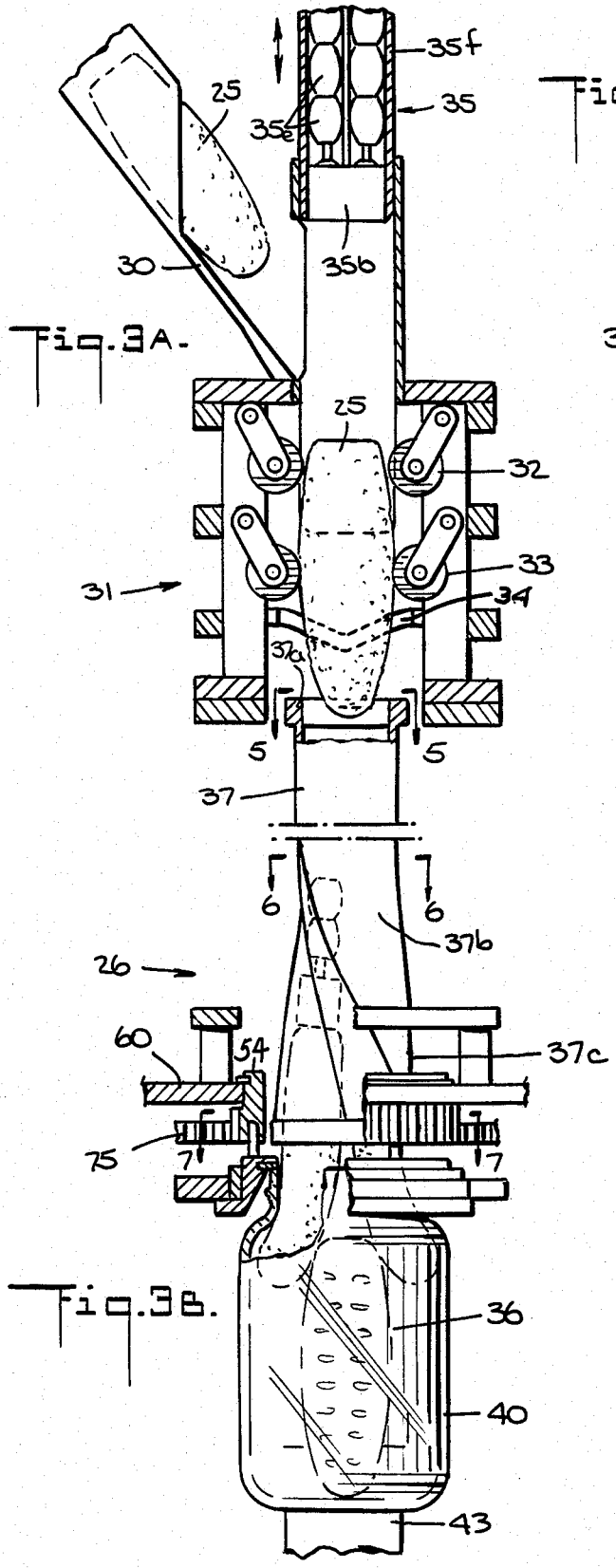
Fig. 3A.
Fig. 3B.
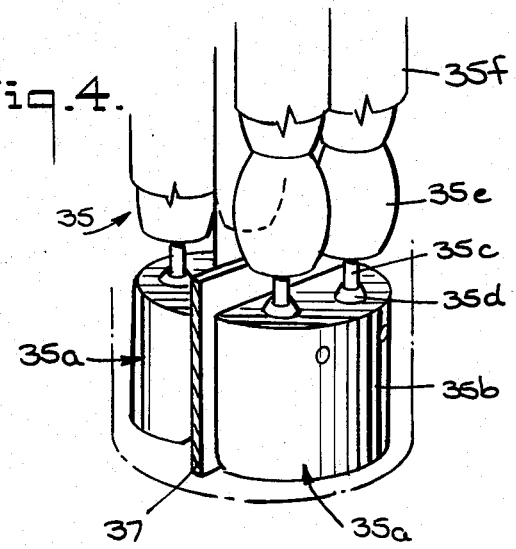
Fig. 4.
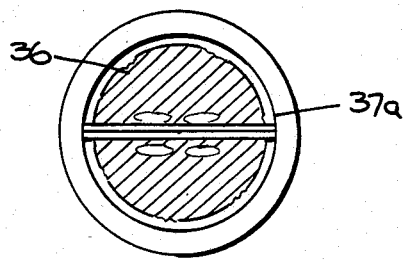
Fig. 5.
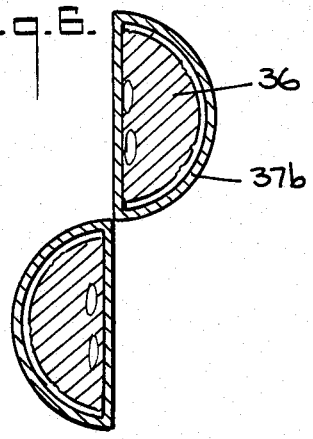
Fig. 6.
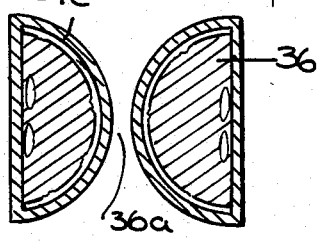
Fig. 7.

35
38
72b
72
63
12
74
69
67a
12
40a
62
35
66
68
67
45a
45d
36
36
13
14
13
14
45
86
87
45b
88
40
84
85
45h
83
61
61
40c
43
125
125
126

METHOD AND APPARATUS FOR PACKING ELONGATED FOOD MATERIAL SUCH AS PICKLE SPEARS

BACKGROUND OF THE INVENTION

1. Field of the Invention

The invention relates to an apparatus for packing elongated articles such as cucumbers or pickles, sliced into the form of spears, into a container with the sliced surfaces of the food material facing outwardly.

Elongated food material such as cucumbers and pickles are often packed in glass containers, i.e. jars, as spears which are obtained by slicing the material along its length into a plurality of sectors. Thus, for example, a pickle may be sliced into five sectors or spears. It is customary to position the spears of a plurality of pickles ajacent the wall of the jar in order to fill all available space adjacent to the wall. A demand has developed for packing spears of substantially large cucumbers or pickles, for example those of nearly two inches in diameter. Such large cucumbers or pickles are typically sliced in half, i.e. two spears. Accordingly, there has developed a need for an apparatus to pack spears resulting from such large cucumbers or pickles each of which has been sliced into two spears.

2. Description of the Prior Art

Prior art machines for packing food material sliced into spears with their sliced surfaces facing outwardly are shown in the applicant's U.S. Pat. No. 3,468,098, which issued on Sept. 23, 1969 for "Spear Packing Apparatus" and in the applicant's U.S. Pat. No. Re. 27,852, which issued on Dec. 25, 1973 for "Spear Packing Apparatus". Briefly, U.S. Pat. No. 3,468,098 and U.S. Pat. No. Re. 27,852 show machines for packing cucumbers or pickles, each sliced into a plurality of spears, such as five spears.

The apparatus of U.S. Pat. No. Re. 27,852 includes a guide which extends into the upper portion of a jar adjacent the mouth thereof. The guide directs the spears sliced from one cucumber or pickle, for example five spears, to positions adjacent the wall of the jar. Since five spears only fill a portion of the jar adjacent the wall thereof, empty spaces remain between the spears. An actuator connected to each of the jar and the guide then simultaneously rotates the jar and the guide so that the spears of the next pickle to be packed can be placed in the empty spaces between the spears of the first pickle already packed in the jar.

SUMMARY OF THE INVENTION

An object of the invention is to provide means for guiding elongated articles such as spears sliced from cucumbers or pickles into containers where the guiding means is rotated with respect to the apparatus in response to the rotation of the container.

Another object of the invention is to provide means for coupling a guiding means when disposed in the interior of the container to the bottom of the container for rotation therewith.

A further object of the invention is to provide means for biasing the guiding means to a predetermined circumferential position with respect to the apparatus in response to the downward movement of the guilding means upon removal of a container from engagement therewith.

These and other objects, features and advantages of the present invention will become apparent and more readily appreciated from the following detailed description of a preferred exemplary embodiment of the invention, taken in conjunction with the accompanying drawings.

The invention comprises an apparatus and a method for packing elongated articles into containers. The apparatus and method of the invention are particularly adapted to pack cucumbers or pickles sliced into spears into glass jars with the spears disposed vertically adjacent the side wall of the jar.

The machine of the invention includes means for rotatably supporting the container at a filling station in substantially an upright position for movement about a vertical axis. There is provided means for delivering spears in a predetermined array to the mouth of the container. In the array, the longitudinal axes of the spears extend substantially vertically and are spaced apart symetrically with respect to one another to form intervals between the spears.

The machine of the invention includes a guiding means which is adapted to extend downwardly through the mouth of a container and into the interior thereof when the container is at the filling station. The guiding means enables the array of spears to be delivered into the container in a predetermined arrangement in which each spear is disposed substantially vertically adjacent to the side wall of the container in circumferential locations corresponding to those of the array and with a space between each spear. The guiding means is pivotally mounted about a vertical axis correspsonding to that of the rotational axis of the container at the filling station.

Means are provided for turning the container about its vertical axis through a predetermined arcuate increment to position unoccupied circumferential locations of the spaces within the container adjacent to locations within the container already occupied by spears.

Means are also provided for indexing the guiding means about its pivotal axis through a predetermined arcuate travel corresponding to the predetermined arcuate increment through which the container is moved.

A feature of the invention is that the means for indexing the guiding means includes means for coupling the guiding means to a bottom portion of the container so that the turning of the container indexes the guiding means through its predetermined arcuate travel. An advantage of this arrangement is that the guiding means caan be indexed in synchronism with the turning of the container without the need of a separate drive for the guiding means.

In one embodiment of the invention, the means for coupling the guilding means to the container comprises suction cups mounted on the guiding means and having the concave portion thereof adapted to face and contact the bottom portion of the container.

Another feature of the invention is that the guiding means is mounted on a stationary shaft which enables the guiding means to rotate with respect to the shaft. Means are provided for biasing the guilding means to a predetermined circumferential position with respect to the shaft in response to the container disengaging the guiding means. One embodiment uses a detent mechanism to accomplish this. Another embodiment uses a clock-spring mechanism to orient the guiding means. As a result, the biasing means positions the guiding means to guide the next array of spears in response to the removal of a container adjacent thereto.

BRIEF DESCRIPTION OF THE DRAWINGS

FIG. 3A is a fragmentary vertical section view showing a side of the upper portion of the apparatus of the invention for slicing cucumbers into a pair of spears for packing in a jar;

FIG. 3B is a fragmentary vertical section rotated 90° with respect to the section of FIG. 3A and showing a pair of spears being directed into a jar;

FIG. 4 is a fragmentary perspective view of a means for pushing spears into a jar;

FIG. 5 is a horizontal section view, taken along the line 5—5 in FIG. 3A and showing a cutting element for slicing a cucumber or pickle into two spears;

FIG. 6 is a horizontal section view taken along the line 6—6 in FIG. 3B and showing chutes for directing the spears to a desired orientation before being packed into a jar;

FIG. 7 is a horizontal section view taken along the line 7—7 in FIG. 3B and showing the lower end of the chutes where the spears are oriented in a reverse position;

DETAILED DESCRIPTION OF THE PREFERRED EMBODIMENT

The apparatus and method of the invention for packing elongated articles, such as spears sliced from cucmbers or pickles, is described hereinafter in accordance with its preferred embodiment and with reference to the accompanying drawings.

Figure 1:
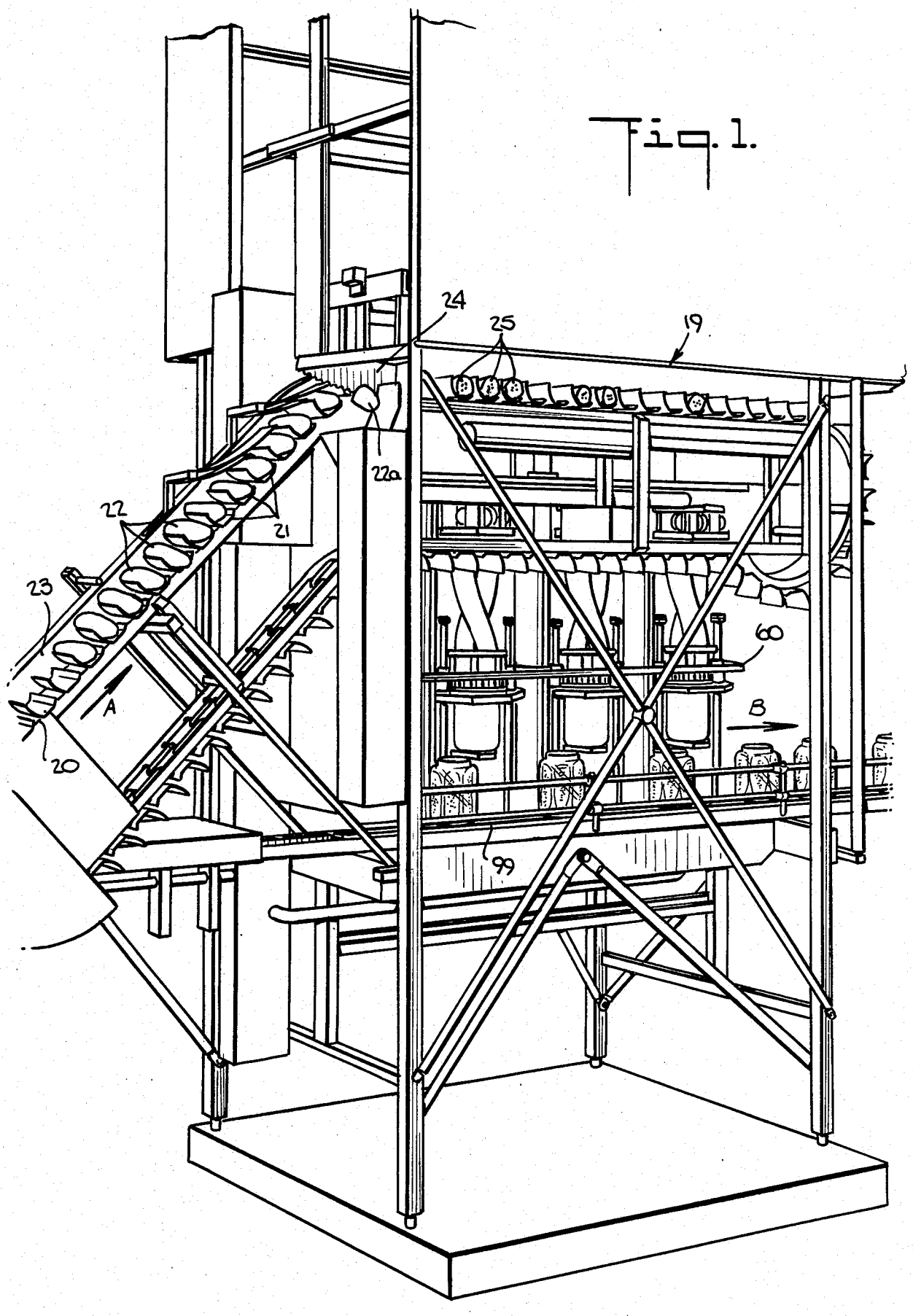
FIG. 1 is a perspective view of the rear portion of an apparatus constructed in accordance with teachings of the invention.

Referring to FIG. 1, the packing apparatus 19 of the invention includes a number of the elements of the apparatus shown in each of the U.S. Pat. No. 3,468,098 and the reissue U.S. Pat. No. Re. 27,852, both of which are incorporated herein by reference. The apparatus includes a product feed conveyor 20 having a plurality of transversely extending pockets 21. Whole cucmbers or pickles 22 are inserted into the pockets 21 with an end of each pickle 22 placed against wall 23 which extends along the upwardly inclined portion of conveyor 20. As seen in FIG. 1, ends of the pickles 22 may extend beyond the end of the pockets 21 disposed opposite wall 23. As conveyor 20 moves in the direction of the arrow A in FIG. 1, past blade 24, the blade cuts away any excess length, i.e., tips **22*a*, to provide pickles 25** with a standard predetermined length.

Figure 2:
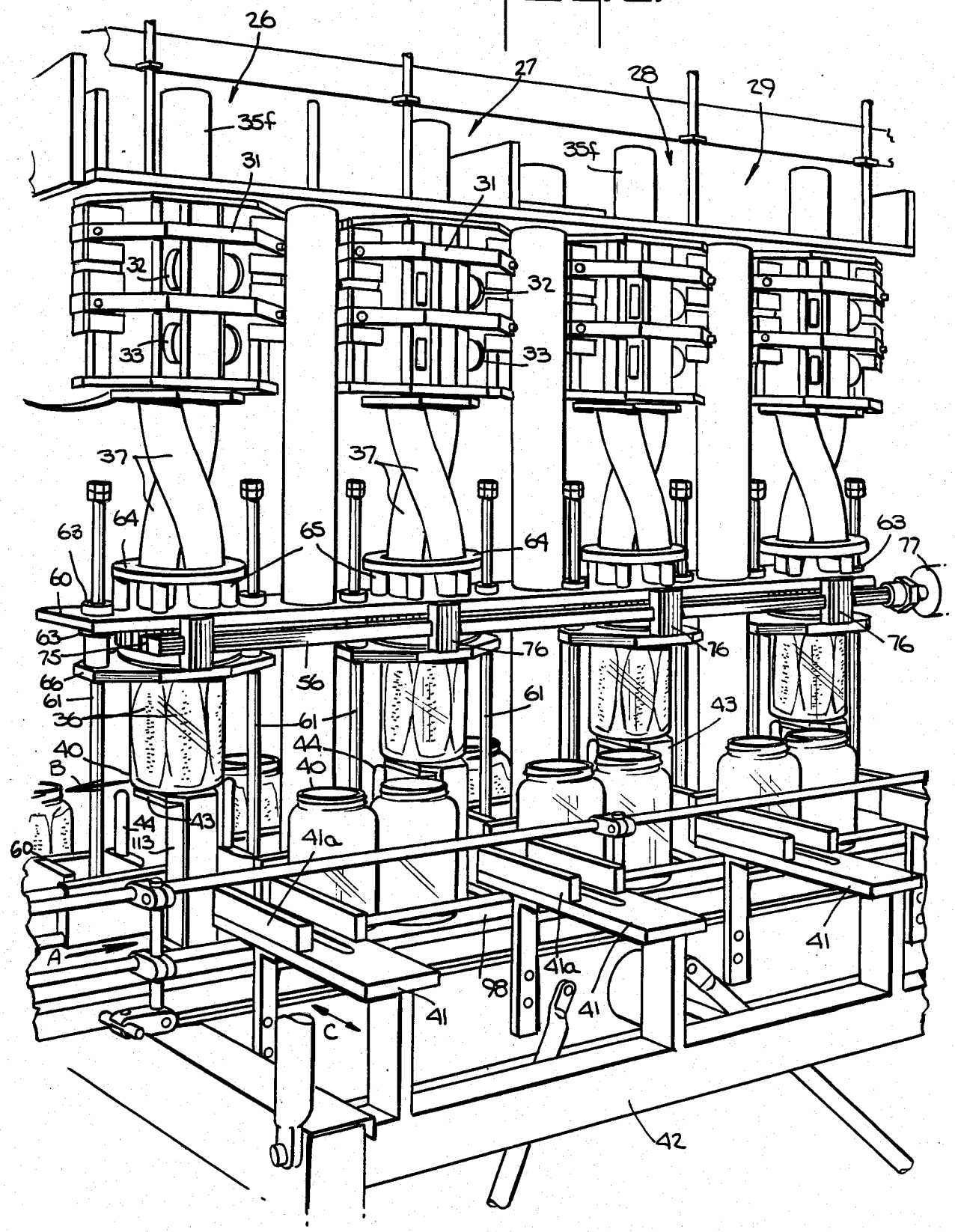
FIG. 2 is a fragmentary perspective view of the front portion of the apparatus of the invention.

The packing apparatus as shown in FIG. 2 consists of four essentially identical packing units 26–29, which are commonly driven for simultaneous operation. Since each of the packing units 26–29 is substantially identical to the others, hereinafter only the construction of packing unit 26 is described.

Referring now to FIG. 3A, packing unit 26 comprises a filling station which includes slide 30 leading into a hopper 31. Hopper 31 contains two sets of rollers 32, 33 which project through openings in the side of hopper 31 to engage the sides of a pickle 25. The rollers 32, 33 ensure that the pickle 25 is centered above slicing knife 34 which is located between the lower set of rollers 33 and the bottom of the hopper 31. Above the hopper 31 is a pushing means 35 which corresponds to that shown in the U.S. Pat. No. 3,468,098 and U.S. Pat No. Re. 27,852. In the illustrated construction, the pushing means includes two assemblies **35*a* (FIG. 4) each of which includes pusher 35*b* and a pair of cables 35*c* connected to the pushers by ball joints 35*d*. Cable 35*c* supports a string of plastic bead-like elements 35*e* within tubular housing 35*f* (FIG. 3A). Housing 35*f* is moved upwardly by means (not shown) to the position shown in FIG. 3A to enable a pickle to enter the hopper from slide 30. Thereafter, housing 35*f* is lowered, which movement causes pushers 35*b* to push a pickle through hopper 31 in engagement with rollers 32 and 33**.

Below the knife 34 at the bottom of the hopper 31 there is disposed means for delivering a plurality of elongated articles, i.e. spears 36, in a predetermined array. The delivering means includes twisted chutes 37 which are connected to the bottom portion of the hopper 31 and into which the spears 36 pass after being sliced by knife 34. In the illustrated construction, there are two chutes 37 since each pickle 25 is being sliced into two halves, i.e. two spears 36. At the top **37*a* of the chutes 37 (FIG. 3A), the spears 36 have their sliced sides facing each other (FIG. 5). Approximately halfway down the chutes 37 at mid-portion 37*b* (where FIGS. 3A and 3B are separated), the spears 36 are rotated to the position as shown in FIG. 6. At the bottom portion 37*c* of the chutes 37 (FIG. 3B), the spears 36 are positioned back-to-back away from each other (FIG. 7). As shown in FIG. 7, spears 36 are spaced apart symetrically with respect to one another to form intervals 36*a*** therebetween.

The spears are forced downwardly with respect to housing **35*f* and through the chutes 37 by a means (not shown) which moves pushing assemblies 35*a*** to adjacent the bottom ends of the chutes.

Figure 17:
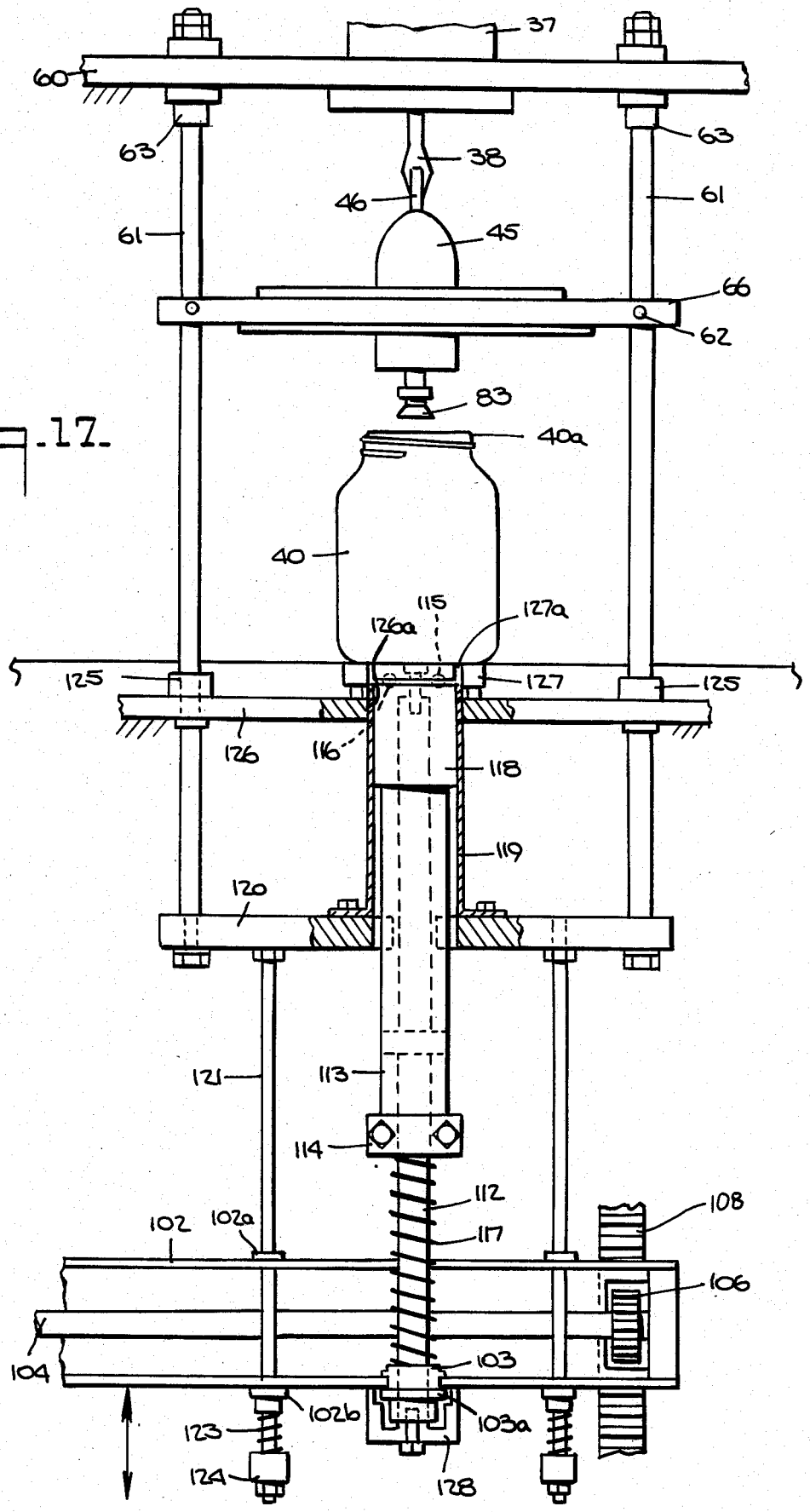
FIG. 17 is an elevational view of a mechanism for raising and lowering the jar to the filling position.

As shown in FIG. 2, empty jars 40 are advanced into the apparatus of the invention in the direction of the arrow B in FIG. 2 by a conveyor (not shown). In a manner similar to that shown in the reissue U.S. Pat. No. Re. 27,852, rams 41 mounted on carriage 42 are cyclically reciprocated to cause the end portion 41*a* of each ram to advance an empty jar 40 onto a means for rotatably supporting a container or jar, namely support 43. Support 43 can be a plastic turntable 115 mounted on ball bearing 116 to enable a jar to be rotated thereon (FIG. 17). Guide rods 44 (FIGS. 2 and 9) position a jar 40 onto the support 43 and stabilize the jar while it is being raised and lowered on support 43.

FIG. 17 also shows the mechanism for simultaneously raising (and lowering) the jar 40 in the four units 26–29 from the conveyor level to the filling position. An actuator (not shown) vertically raises a lift bar 102, which extends horizontally below the four units 26–29. The lift bar 102 rotatably supports horizontal shaft 104 which has a gear 106 mounted on each end of the opposite ends of shaft 104. Only one gear 106 is shown in FIG. 17. Vertically extending racks 108 (only one shown in FIG. 17) are engaged with each of gears 106. The engagement of the racks and gears enable shaft 104 to maintain lift bar 102 horizontal as it is moved vertically.

For each unit 26–29, the lift bar 102 is provided with a bushing 103 mounted thereon and retained by snap-ring 103. Lift shaft 112 is slidably supported with respect to lift bar 102 by bushing 103. Lift shaft 112 extends vertically adjacent guide bar 113. Retainer 114 is clamped to the guide bar 113 and lift shaft 112. Spring 117 surrounding lift shaft 112 abuts bushing 103 and retainer 114. Accordingly, the spring provides a resilient link between the lift bar 102 and lift shaft 112. Bearing bottom 118 is supported by lift shaft 112. The bearing bottom moves within the cylindrical interior of guard 119 which is mounted on tie bar 120.

Pull rods 121 are connected at their upper ends to tie bar 120 and slidably extend through bushings 102*a* and 102*b* on lift bar 102. Springs 123 disposed between bushings 102*b* and stops 124 mounted on pull rods 121 provide a resilient coupling between the pull rods and the tie bar 120. Uprights 61 slidably extend through bushings 125 in bed plate 126. Support 43 (FIGS. 2 and 9) comprises dead plate 127 and turntable 117 (FIG. 17). Dead plate 127 is mounted on bed plate 126. Within the opening 127*a* of the dead plate is disposed about turntable 115, mounted on ball bearings 116. Bolt 128 retains turntable 115 with respect to lift shaft 112.

Figure 8:
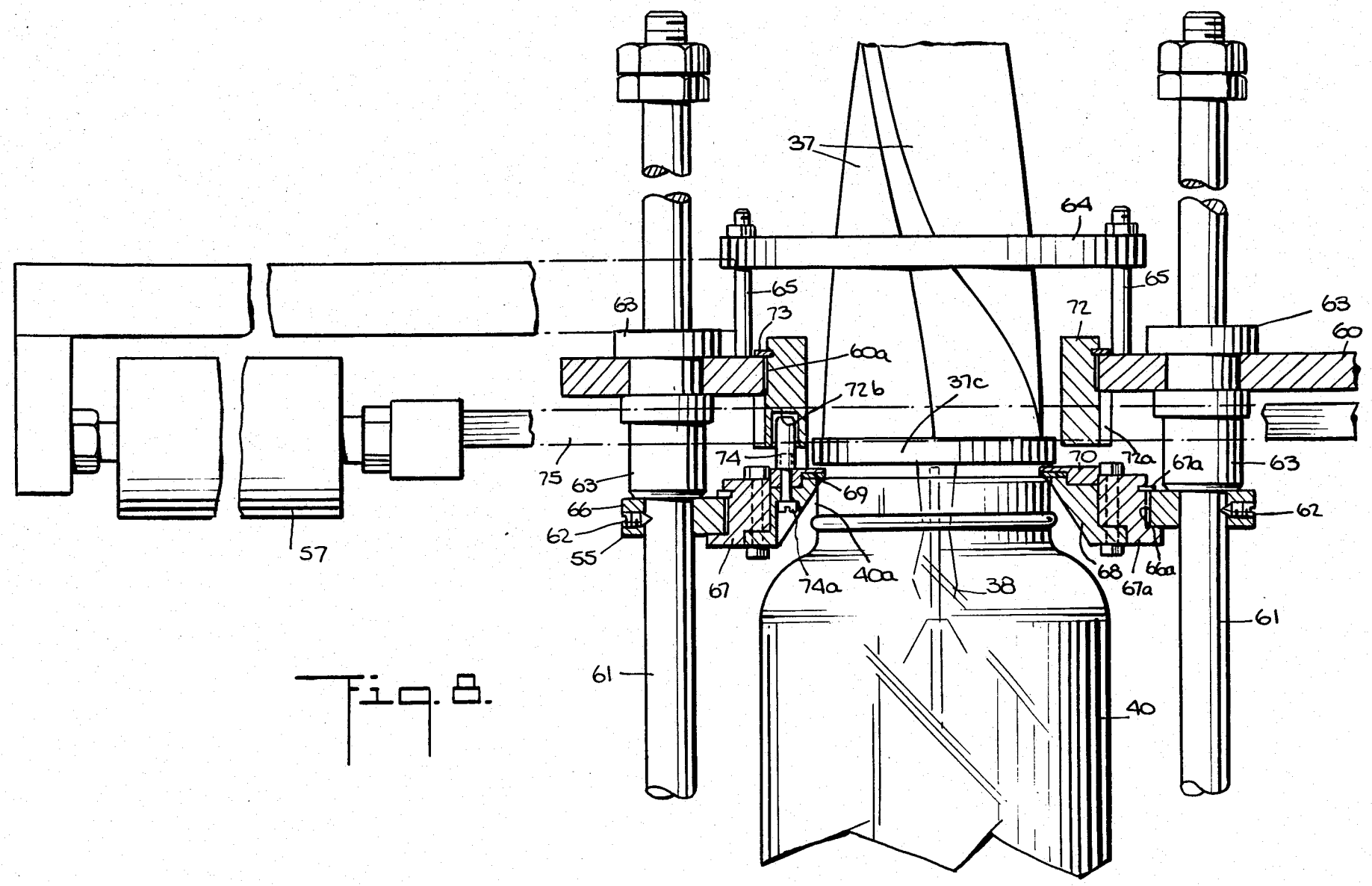
FIG. 8 is a fragmentary vertical section view showing a means for rotating a jar at a filling station.

As the lift bar 102 is elevated, it transmits force through bushing 103 to spring 117 and thereby to retainer 114 which transmits the force to lift shaft 112. The lift shaft then elevates turntable 115 with respect to dead plate 127, thereby raising the jar 40. When the upper portion 40*a* of the jar intersects resilient ring 69 as shown in FIG. 8, thereafter plate 66 is elevated by the jar and with the plate, uprights 61 which are attached to plate 66 by set screws 62. Further upward movement of jar 40 causes plate 66 to be elevated until it abuts the bottom portion of bushings 63 mounted on fixed center plate 60 as shown in FIG. 8. It should be noted that upward movement of lift bar 102 does not initially move tie bar 120. Thus, as lift bar 102 is initially elevated, the lift bar simply slides along pull rods 121. It is only when the top portion of the jar abuts the resilient member 69 that plate 66 begins to move upwardly. This movement is transmitted to uprights 61 which are connected to plate 66 by set screws 62. In turn, uprights 61, connected to tie bar 120, move the tie bar upwardly. As tie bar 120 (FIG. 17) moves upwardly, guard 119 passes through opening 126*a* in bed plate 126.

When the upper portion 40*a* of the jar abuts the resilient member 69 (FIG. 8), the compression of the upper portion 40*a* with respect to the resilient member is limited by the spring characteristic or constant of spring 117 (FIG. 17). Thus, the spring 117 can compress and prevent excessive force from being applied to the jar which could otherwise crush the jar when plate 66 abuts bushings 63 of center plate 60 (FIG. 8).

When lower plate 66 contacts bushing 63, the jar 40 is in the filling position. Pin 74 engages socket 72*b* in pinion 72. The jar 40, plate 66, uprights 61, tie bar 120, pull rods 121 and lift shaft 112 no longer rise (FIG. 17). Any further elevation of the lift bar 102 simply compresses spring 117 to insure a tight seal of the jar's upper portion 40*a* on the resilient ring 69. The apparatus, therefore, can accommodate a range of jar heights because the spring has a range of compression.

Figure 9:
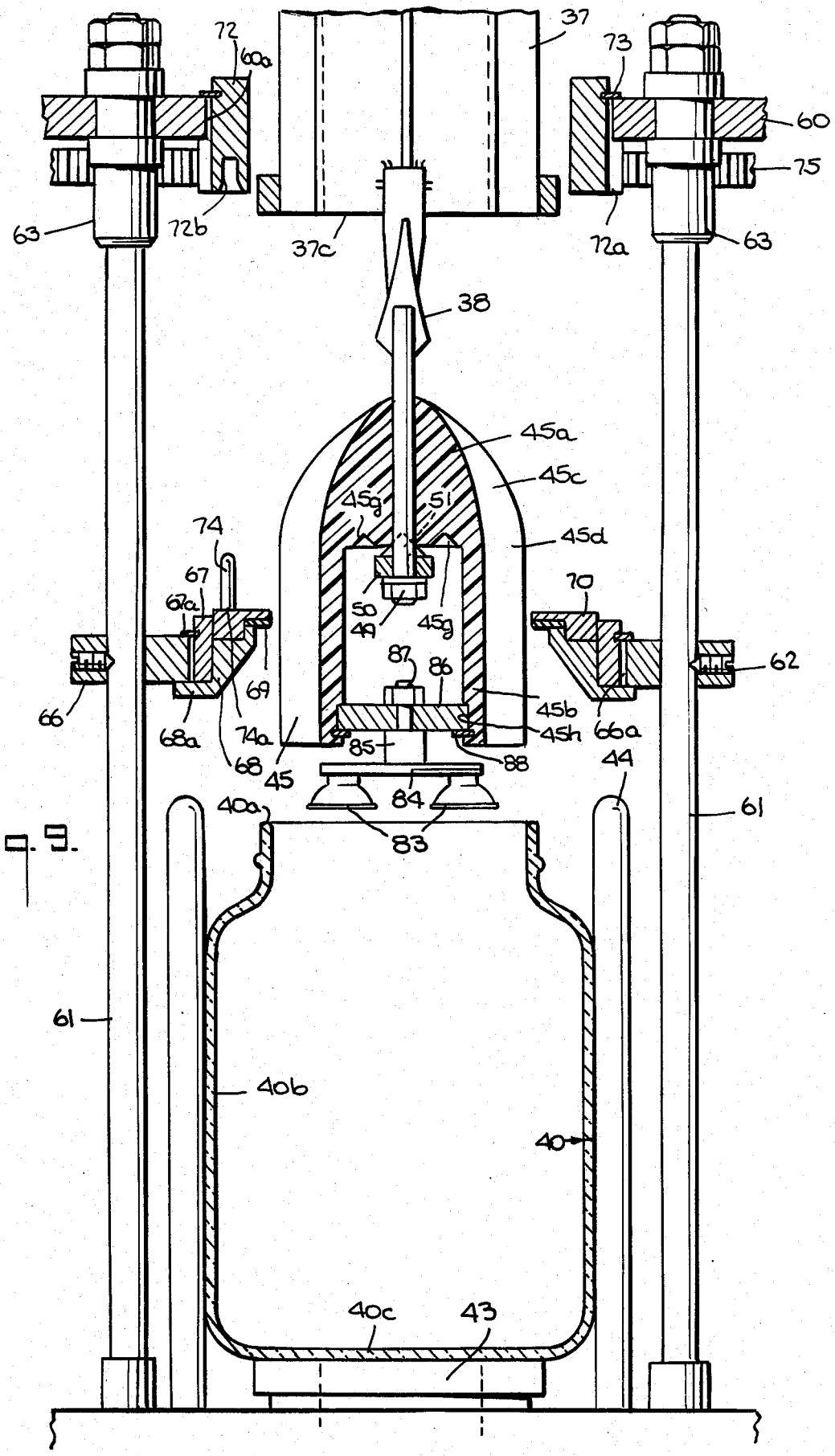
FIG. 9 is a fragmentary vertical section view of the apparatus of the invention for supporting and elevating a jar for packing.
Figure 14:
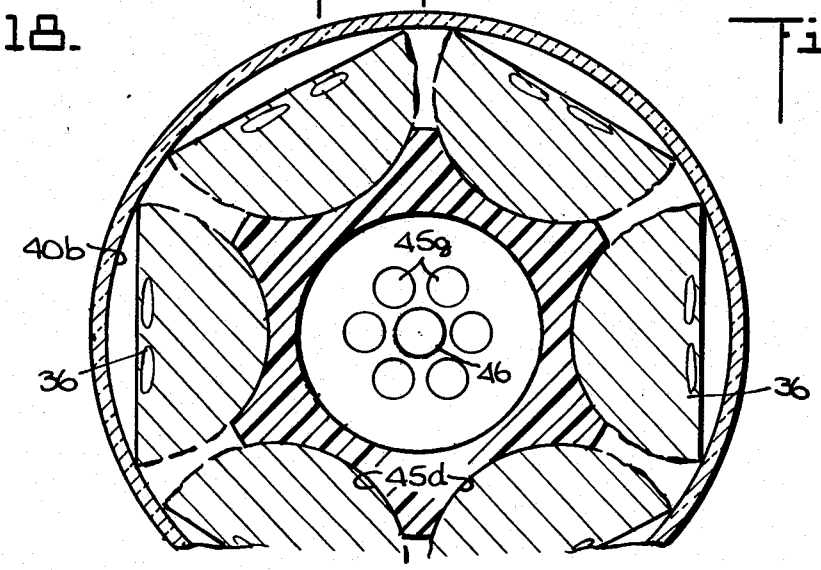
FIG. 14 is a horizontal section view taken along the line 14—14 in FIG. 10 and showing slots in the bottom portion of the guiding means.
Figure 19:
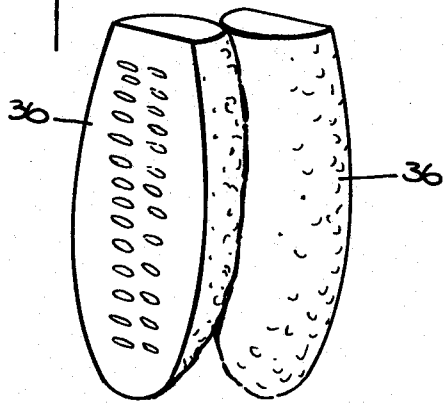
FIG. 19 is a perspective view of a cucumber or pickle sliced into two spears with the sliced surfaces thereof disposed opposite to one another.
Figure 18:
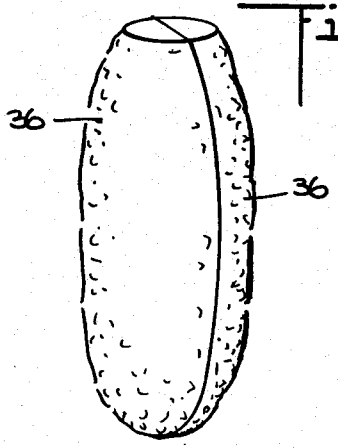
FIG. 18 is a perspective view of a still intact cucumber or pickle sliced into two spears.
Figure 12:
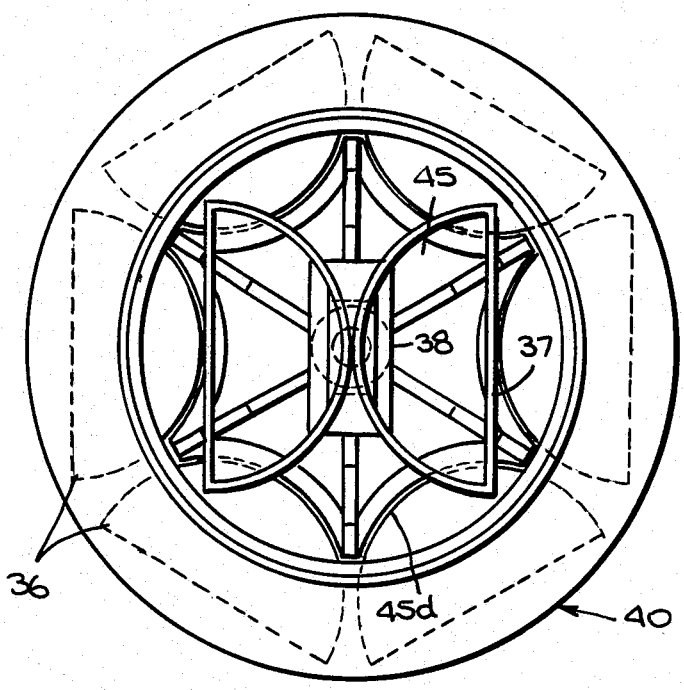
FIG. 12 is a horizontal section view taken along the line 12—12 in FIG. 10 and showing the lower end portion of the chutes, the deflector for the spears, and the guiding means.
Figure 13:
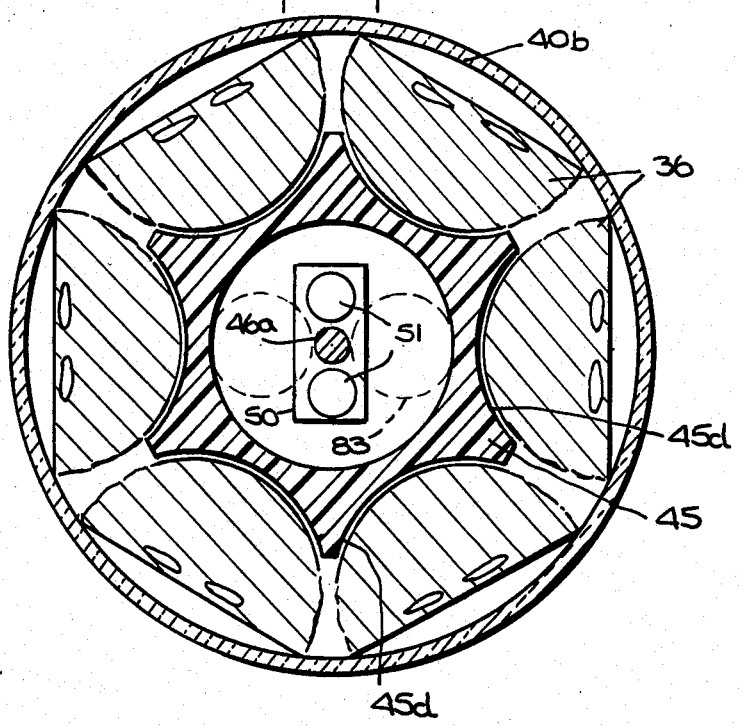
FIG. 13 is a horizontal section view taken along the line 13—13 in FIG. 10 and showing the guiding means, the spears positioned within the jar, and the biasing means.
Figure 15:
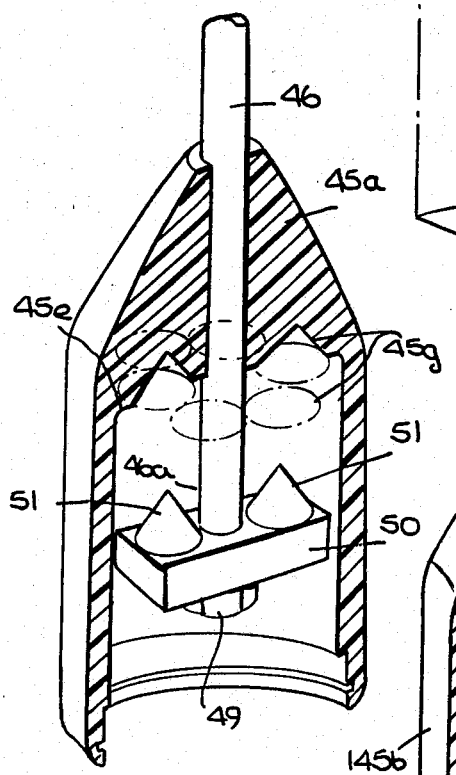
FIG. 15 is a fragmentary perspective view partially in section showing the deflector, the guiding means, and a detent biasing means of the apparatus of the invention.
Figure 16:
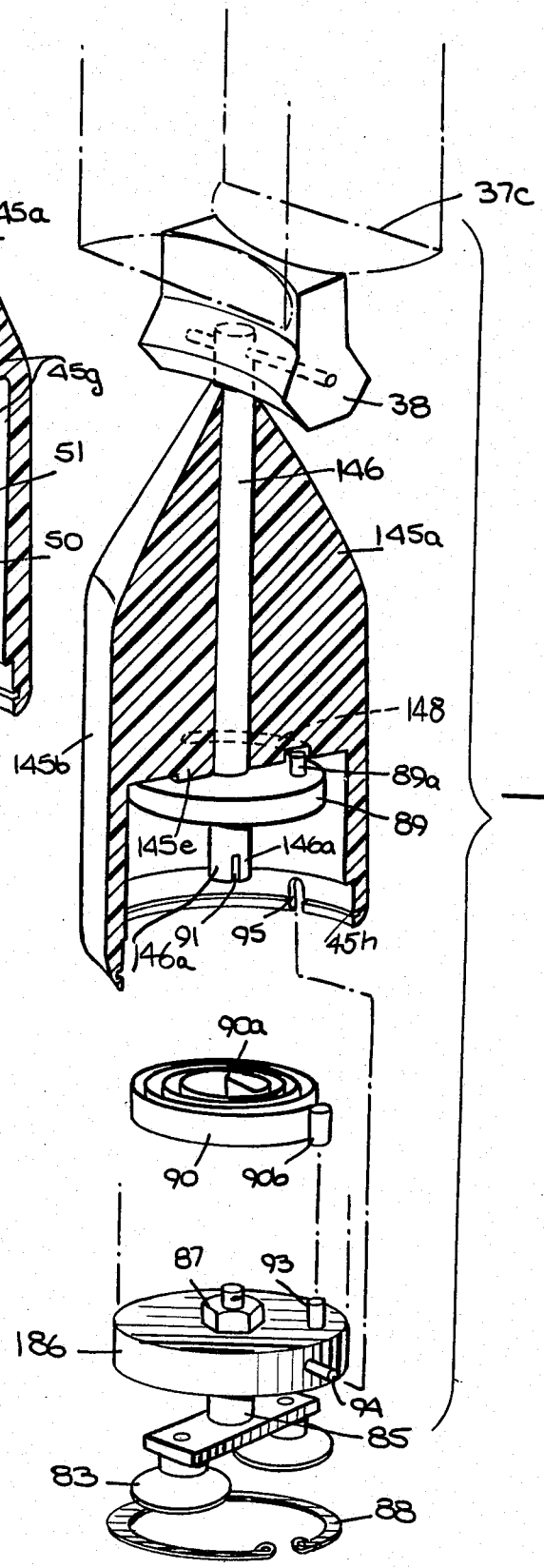
FIG. 16 is an exploded fragmentary perspective view partially in section showing the biasing means including a clock-spring biasing means for the guiding means.

In FIG. 9, jar 40 is shown positioned on support 43 adjacent to guide rods 44. The opening of the jar is then in a position of alignment with the means for guiding an array of spears, namely guide 45. Guide 45, as shown in FIGS. 9, 15 and 16 has a cone-shaped body portion 45*a* disposed above a cylindrical portion 45*b*. Guide 45 includes indentations 45*c* (FIG. 9) which extend vertically with respect to the cone-shaped body portion 45*a*. In addition, the guide includes indentations 45*d* extending along cylindrical portion 45*b* with the indentations 45*c* and 45*d* being aligned with one another. As shown in FIGS. 12, 13 and 14, the illustrated construction has (by way of example) six indentations 45*d* in the cylindrical portion which are in alignment with six corresponding indentations 45*c* (not shown) in the cone-shaped body. Further by way of example, the six indentations are semi-circular because a pair of chutes 37 (FIG. 12) delivers spears 36 which comprise half-slices of a cucumber or pickle (FIGS. 18 and 19). It can be seen in FIGS. 12 and 13 that the guide 45 serves to position the spears substantially vertically adjacent to the side wall 40*b* of the container and in circumferential locations which correspond to those of the predetermined array of spears defined by the bottom portion 37*c* of the chutes (FIG. 3B).

Guide 45 is pivotally mounted on vertically extending shaft 46 which is connected to deflector 38 (FIG. 9). The deflector 38 is mounted upon the bottom end portion 37*c* of the chutes (FIG. 15). A positioning means is located at the bottom portion 45*e* of the cone-shaped body 45*a* (FIGS. 9 and 15). One embodiment of the positioning means for guide 45 comprises a detent mechanism. In this embodiment, the bottom portion 45*e* of cone-shaped body portion 45*a* has a plurality of downwardly facing conical recesses 45*g* which are disposed in a circle centered about the vertical axis of the cone-shaped body portion 45*a*. Each of the recesses 45*g* is contiguous to the recesses adjacent thereto. In addition, each recess 45*g* is radially aligned with a different one of indentations 45*c* and 45*d* of the guide 45. Attached to lower end 46*a* of the shaft is carrier 50 upon which is mounted cone-shaped pins 51 which are disposed at a radial distance from the center of shaft 46 which corresponds to the radius of the circle of the recesses 45*g* in the bottom portion 45*e* of the cone-shaped body portion. Carrier 50 is secured on shaft 46 by nut 49.

Whenever there is no jar 40 in engagement with guide 45, for example as shown in FIG. 9, guide 45 descends vertically along shaft 46. Whereupon the cone-shaped pins 51 act as a detent mechanism or a biasing means by entering two oppositely disposed recesses 45*g* of the plurality of recesses in the bottom portion of the cone-shaped body, thereby positioning the guide with respect to shaft 46. As shown in FIG. 14, each of recesses 45*g* are in alignment with indentations 45*d*. Accordingly, whenever pins 51 are nested in recesses 45*g*, the guide 45 is maintained in a predetermined position with respect to the bottom portion 37*c* of chutes 37. This predetermined position is shown in FIG. 12. As a result, spears 36 can be advanced downwardly from the chutes into contact with deflector 38 and then into the indentations 45*c* and 45*d* of the guide.

FIG. 16 shows an alternate embodiment of the positioning mechanism using a clockspring. In this embodiment, coneshaped portion 145*a* of guide 145 has a groove 148 extending circumferentially for a portion of the circumference of the bottom 145*e* of the cylindrical portion 145*b* of the guide 145. This groove 88 extends for a length greater than the rotational index movement of the guide 145 (120° in the illustrated construction). A disc 89 is fixedly mounted on the lower end 146*a* of the shaft 146. Pin 89*a* extending from the upper face of disc 89 travels in groove 148. The disc 89 is positioned to enable guide 145 to rotate about shaft 146 with bottom 145*e* in sliding contact with the top portion of disc 89 with the uppermost portion of cone-shaped body portion 145*a* disposed adjacent the bottom portion of deflector 38. The disc 89 is fixed on the shaft 146 in a predetermined circumferential orientation such that the pin 89*a* contacts the end of groove 148 when indentations in guide 145 corresponding to those of guide 45, indentations 45*c*, 45*d* are aligned with the chutes 37 and deflector 38.

A clockspring 90 has end tab 90*a* thereof mounted in slot 91 in the bottom of the end plate 46*a* of shaft 46. The clockspring has an outer loop 90*b* engaged with pin 93 on carrier 186. After winding of the spring 90, the carrier 186 is inserted in the bottom of the cylindrical portion 145*b* of the guide 145 with pin 94 engaged with groove 95.

When guide 145 of FIG. 16 is rotated incrementally with jar 40 during the filling operation, the guide moves clockwise when viewed from below in FIG. 16. Each incremental rotational movement of guide 145 moves end loop 90*b* of clockspring 90 since the loop is engaged to pin 93 on carrier 186 which rotates with the guide. Since tab 90*a* of clockspring 90 is held stationary by slot 91 in the end 146*a* of shaft 146, clockspring 90 becomes incrementally wound or tightened each time pin 89*a* advances along groove 148. When the jar is lowered after filling and disengaged from the guide, the clockspring then drives the guide counterclockwise as viewed from below in FIG. 16 to its rest position in which the guide 145 is ready to receive spears at the commencement of the next filling cycle.

Figure 11:
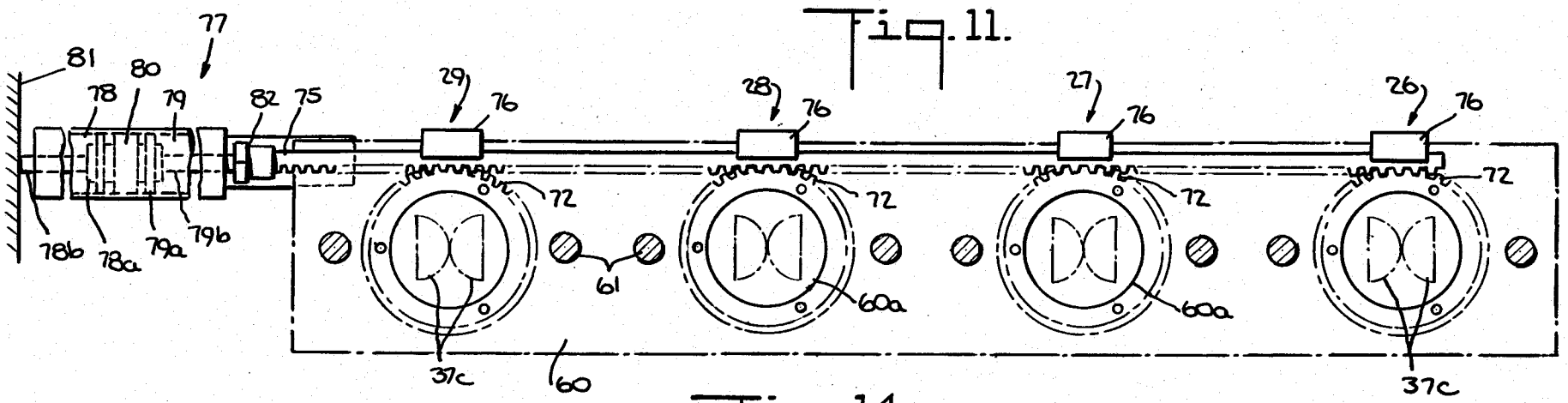
FIG. 11 is a plan view showing a rack and pinions for rotating the jars.

As shown in FIGS. 1, 8 and 11, fixed base plate 60 extends along the length of the machine and is provided with openings 60*a* (FIGS. 8 and 11) through which the lower end portions 37*c* of the chutes extend. Upper plate 64 (FIG. 8) is supported with respect to base plate 60 by sleeves 65. The upper plate 64 supports the lower end portion of the chutes 37*c*.

As shown in FIGS. 8 and 9, lower plate 66 contains a circular opening 66*a* in which is rotatably mounted the means for engaging the container at the filling station when the top portion 40*a* of the container is positioned at a predetermined level with respect to the apparatus. The means for engaging the container includes carrier 68 which is fixedly disposed in circular opening 67*a* of ring 67. Ring 67 is pivotally mounted in circular opening 66*a* with the shoulder 67*a* abutting the lower surface of lower plate 66. Ring 67 which is attached to carrier 68 is pivotally mounted within circular opening 66*a* by means of snap ring 67*a*. Resilient member or ring 69 is clamped in position on the carrier by retainer 70. When lower plate 66 is moved vertically by container 40 abutting resilient member 69, and comes into contact with bushings 63, resilient member 69 is then disposed at the predetermined level within the apparatus at which the top portion 40*a* of the container is engaged to the resilient member 69.

As shown in FIG. 8, pinion 72 having teeth 72*a* is rotatably mounted with respect to base plate 60 by snap ring 73. The rotational movement of pinion 72 is coupled to carrier 68 and thereby resilient ring 69 by means of pin 74, mounted in carrier 68 by screw 74*a* and engaged with socket 72*b* in pinion 72. Pin 74 is engaged with socket 72*b* of the pinion 72 when lower plate 66 is elevated.

As shown in FIG. 11, each of pinions 72 at stations 26–29 is driven in rotation by rack 75. As shown in FIG. 2, the rack is slidably supported by blocks 76 extending downwardly from base plate 60. The rack 75 is driven by actuator 77 which can be a pneumatic or hydraulic actuator. When the actuator 77 is in its rest position (to the left as viewed in FIG. 11) sockets 72*b* in pinions 72 are in alignment with pins 74 extending from carriers 68. The actuator 77 includes two cylinders 78 and 79 with wall 80 separating the cylinders (FIG. 11). Cylinder 78 includes piston 78*a* attached to piston rod 78*b* which in turn is attached to a frame member 81 of the apparatus 19. Accordingly, the application of pressure to cylinder 78 enables the actuator 77 together with the rack 75 to be reciprocated with respect to frame member 81 since piston rod 78*b* is attached to the frame member. Cylinder 79 of the actuator 77 includes piston 79*a* attached to piston rod 79*b*. Coupling 82 connects piston rod 79*b* to rack 75.

Upon applying pressured fluid to cylinder 79, piston 79*a* and thereby piston rod 79*b* can reciprocate rack 75 with respect to actuator 77. With the arrangement of actuator 77, which comprises the means for moving the engaging means to turn a rotatably supported container engaged therewith, there can be two predetermined movements of rack 75 which enable the rack to rotate the pinion 72 with two predetermined rotational motions. Thus, applying pressured fluid sequentially to the right side of cylinder 78 and to the left side of cylinder 79 (as viewed in FIG. 11) enables the rack to be moved through two predetermined strokes extending to the right. By applying pressured fluid to the opposite side of each of the pistons, actuator 77 can be returned to adjacent frame member 81, thereby moving the rack to the left.

As shown in FIGS. 2 and 9, a jar 40 has been advanced by ram 41 with respect to support 43 to a position adjacent guide rods 44 beneath guide 45. The guide 45 is shown at its bottommost position with respect to shaft 46. In this position, cones 51 are engaged with recesses 45*g* to index the guide 45 to a predetermined position in which indentations 45*c* are in alignment with deflector 38 and the bottom portion 37*c* of the chutes.

Figure 10:
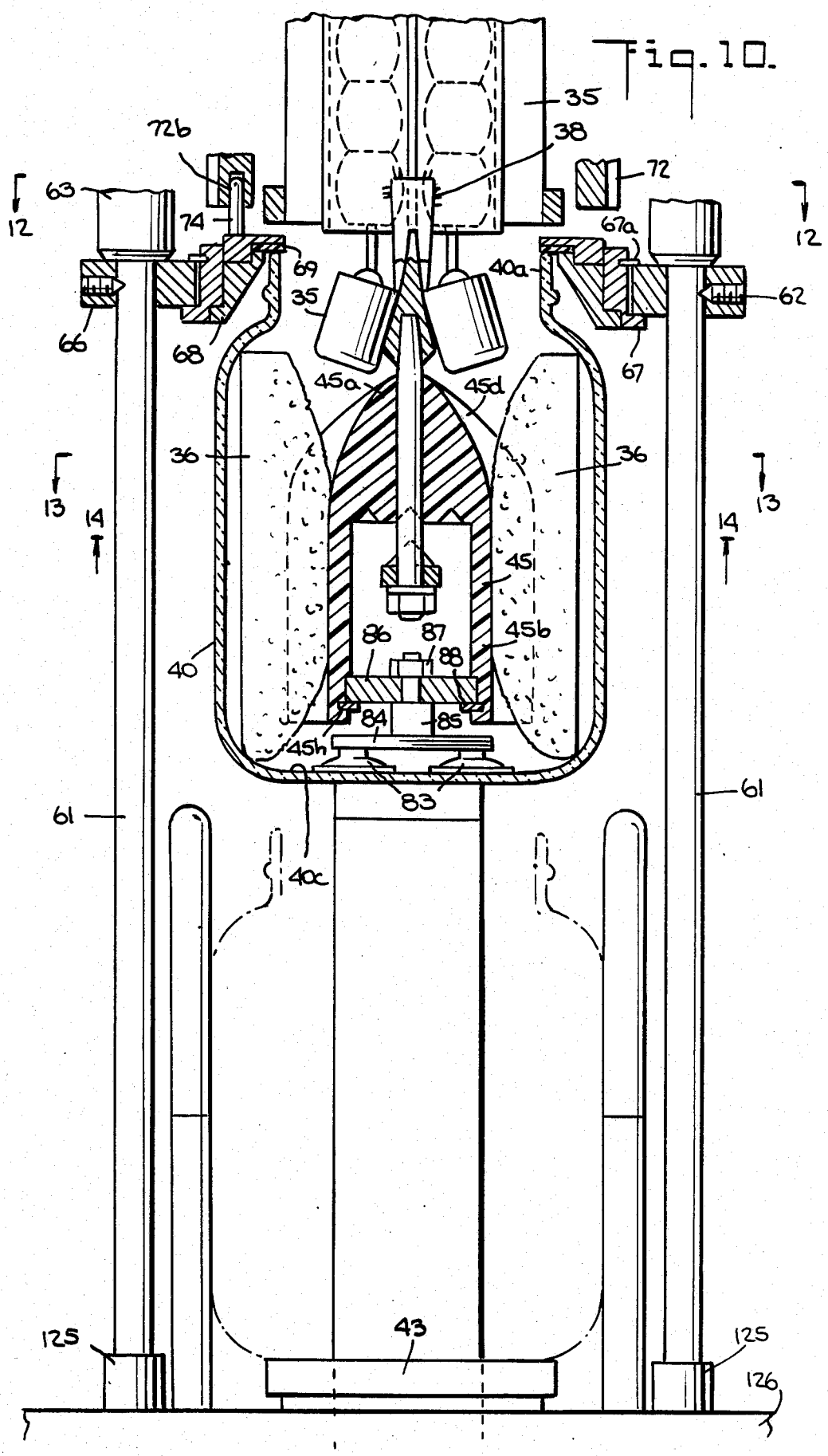
FIG. 10 is a fragmentary vertical section view of a jar having its top portion in contact with the engaging means and showing the means for moving the engaging means.

As shown in FIG. 10, jar 40 has been elevated by support 43 so that top portion 40*a* of the jar is at the predetermined level and in engagement with resilient member 69. In this position, the means for indexing the guiding means, guide 45, can rotate the jar about the vertical axis thereof. The indexing means includes suction cups 83 which are engaged to the bottom portion 40*c* of the jar when the jar is at the predetermined level. The suction cups are mounted upon bar 84 which is attached to stud 85, mounted with respect to carrier 86 by nut 87 threaded thereto. The carrier 86 is retained within groove 45*h* in cylindrical portion 45*b* of guide 45 by snap ring 88.

It can be seen in FIG. 10 that when the jar is elevated to the predetermined level at which the top portion of the jar engages resilient member 69, the suction cups 83 can couple the guide 45 to the bottom portion 40*c* of the jar. As a result, rotational movement for indexing the guide 45 can be transmitted from the rack 75, through the pinion 72, through pin 74 disposed in opening 72*b* of the pinion, to carrier 68 and resilient member 69, and thereby to the jar 40 disposed upon support 43.

In operation of the apparatus of the invention where the cucumbers or pickles to be packed are sliced into pairs, and where three pairs of slices 36 are to be disposed in a container as shown in FIGS. 12 and 14, the three pickles to be packed in the form of six slices 36 require three cycles of the introduction of pickles into hopper 31 and three cycles of operation of the pusher assembly 35. Thus, with jar 40 in the position shown in FIG. 10, a first pair of slices 36 in response to the operation of pusher assembly 35 advances past deflector 38 and into indentations 45*d* of the cone-shaped portion 45*a* of guide to position the slices vertically within the jar (FIGS. 10, 12, 13 and 14).

One of cylinders 78 and 79 of actuator 77 shown in FIG. 11 is then actuated to advance rack 75 a single increment. The advancement of the rack rotates pinion 72 clockwise as viewed in FIG. 11. Turntable 115 (FIG. 17) of support 43 facilitates rotation of the jar. The jar and guide 45 engaged therewith are rotated by the rack (FIG. 11) to a position of the guide in which the indentations 45*c* and 45*d* thereof are in alignment with deflector 38 in the bottom portion 37*c* of the chutes to receive the second pair of slices 36. A further incremental motion of the rack is achieved by actuating the remaining one of cylinders 78 and 79. This actuation rotates the jar and thereby the guide 45 to again align the indentations 45*c* and 45*d* to receive the final pair of slices.

After filling, the jar 40 is lowered in a manner which is the reverse of the raising operation. The actuator connected to the lift bar 102 lowers the lift bar (FIG. 17). Initially the lowering of the lift bar unloads spring 117 (which maintains the jar 40 in contact with the resilient member 69). When the lift bar moves downwardly with respect to pull rods 121, the lift bar eventually loads springs 123. Thus, springs 123 bear against stops 124 and apply a downward force to pull rods 121, tie bar 120, uprights 61 and lower plate 66. The lower plate 66 exerts a downward force on the jar 40 to disengage the top portion of the jar from the resilient member 69 and to move the jar downwardly and out of engagement with the suction cups 83 and to a position below the guide. At this time, pin 74 is withdrawn from socket 72*b* in pinion 72.

Descent of lift bar 102 also results in the lift bar abuting bumper 128. When bumper 128 is abutted, it applies a downward force to lift shaft 112. Finally, when turntable 115 is lowered to the conveyor level shown in FIG. 17, the jar 40 is positioned to be offloaded onto the exit conveyor 99 (FIG. 1). The clearance between the lower plate 66 and the jar 40 allows the jar 40 to be removed without obstruction.

Upon lowering jar 40 downwardly from the position shown in FIG. 10 for discharge from the filling station by ram 41, guide 45 slides downwardly by gravity with respect to shaft 46. At the bottom of its travel, guide 45 is indexed into its predetermined position by the indexing mechanism including cone-shaped pins 51 and recesses 45*g*. In the embodiment of the invention including guide 145, clockspring 90 serves as the indexing mechanism for the guide.

OPERATION

The preferred embodiment of the invention operates as set forth below. Empty jars 40 are delivered to the apparatus of the invention on input conveyor 98 moving in the direction of arrow A in FIG. 2. After filling, jars 40 are taken away from the apparatus on exit conveyor 99 moving in the direction of the arrow B in FIGS. 1 and 2. Rams 41, moving in the direction of the arrow C in FIG. 2 (the arrow adjacent ram 41), move empty jars 40 from input conveyor 98 onto support 43. In so doing, the empty jars 40 push full jars from supports 43 and deliver the full jars onto exit conveyor 99. Thereafter, support 43 is raised so that the upper portion 40*a* of each jar engages a resilient member 69 (FIGS. 8 and 10).

The first pickle 25 to be packed is then cut into slices, such as a pair of half slices or spears 36 (FIG. 18). The cutting is accomplished by pusher assembly 35 which drives a pickle 25 out of the hopper 31, through knife 34, and into the twisting chutes 37 (FIG. 3A). The resulting spears 36 are pushed down the chutes 37 where they are rotated about their length with the result that the cut portion of each spear 36 faces outwardly.

The spears 36 are then ready to be packed into the jar 40. The spears 36 are advanced by the pusher assembly 35 to pass along the deflector 38 into the jar 40 (FIG. 10). The spears 36 descend along the cone-shaped body 45*a* and into the indentations 45*c* and 45*d* thereof to form a predetermined array along the jar wall 40*b*. The cylindrical portion 45*b* of the guide including indentations 45*d* hold the spears 36 against the inside wall of the jar 40*b* (FIGS. 13 and 14).

The apparatus is then made ready for the packing of a second pickle 25. The pusher assembly 35 is retracted upwardly to enable a second pickle to enter hopper 31 (FIG. 3A). Actuator 77 advances the rack 75 to the right (FIG. 11). The rack 75 rotates the pinion 72 and thereby resilient member 69 which rotates the jar 40 resting on the ball- bearing supported turntable 115 of support 43 (FIG. 17). The bottom portion 40*c* of the jar 40 which is engaged by the suction cups 83 rotates the guide 45, thereby aligning the guide so that the next group of spears 36 can be located between the indentations 45*d* of the guide adjacent to those occupied by spears 36 from the previous operation of the pusher means 35.

The apparatus of the invention can use more than two pickles 25 to fill the jar 40. Thus, the guide 45 can be rotated, by way of example, through an arc corresponding to 360°, divided by the number of chutes 37, and divided by the desired number of pickles 25 to be packed into the jar 40. Thus, in the illustrated construction, the jar 40 and guide 45 are rotated through 360°, divided by two, and divided by three, i.e., a 60° step between operations of the pusher assembly 35, since three pickles 25 are being packed as six sliced half-spears 36.

Once the jar 40 has been rotated through the first rotation, the pusher assembly 35 drives another pickle 25 through the knife 34, down the chutes 37, and into the jar 40. Since the guide 45 has been rotated, the spears 36 are positioned between spears 36 of the previous action. The actuator 77 is then operated to rotate the jar 40 and guide 45 once more. Another pickle 25 is then sliced into spears 36 and inserted into the jar 40.

Once the filling of a jar is completed, the filled jar 40 is then lowered on support 43 until the bottom portion of the jar 40 is level with the exit conveyor 99. Lowering the lower plate 66 for a portion of the down-stroke stabilizes the jar 40 and releases suction cups 83 from the bottom portion 40*c* of the jar. The weight of guide 45 causes the guide to descend along shaft 46 thereby enabling the indexing means to position the indentations of the guide 45 to be in the proper position to receive spears 36 when the next jar 40 is raised on support 43.

Empty jars 40 from the input conveyor 98 then push full jars 40 onto the exit conveyor 99. The filled jars 40 are then advanced out of the apparatus. If desired, additional spears 36 can be placed adjacent to the central region of the interior of the jar 40 between the pairs of spears packed against the wall 40*b* of the jar.

What is claimed is:

1. In an apparatus for packing elongated articles into containers having a bottom portion, a side wall portion, and a top portion with a mouth for providing access to the interior of the container, the apparatus having means for rotatably supporting a container at a filling station in substantially an upright position for movement about a vertical axis when the top portion of the container is at a predetermined level;

means for engaging the container at the filling station when the top portion thereof is at the predetermined level;

means disposed adjacent the filling station for delivering a plurality of elongated articles in a predetermined array to adjacent the mouth of the container when the top portion thereof is at the predetermined level, the elongated articles in the predetermined array having their longitudinal axes extending substantially vertically and spaced apart symetrically with respect to one another to form intervals between the plurality of elongated articles, means disposed beneath the delivering means and adapted to extend downwardly through the mouth of the container into the interior thereof when the top portion of the container is at the predetermined level for guiding the predetermined array of a plurality of elongated articles from the delivering means into a predetermined arrangement within the interior of the container in which each elongated article is disposed substantially vertically adjacent to the side wall of the container in circumferential locations corresponding to those of the predetermined array with a space between each elongated article corresponding arcuately to the interval between adjacent elongated articles in the predetermined array, means for pivotally mounting the guiding means about a vertical axis substantially corresponding to the vertical rotational axis of a container rotationally supported at the filling station when the top portion of the container is at the predetermined level;

means for moving the engaging means to turn the rotatably supported container engaged therewith about its vertical axis through a predetermined arcuate increment to position unoccupied circumferential locations of the spaces within the container immediately adjacent circumferential locations within the container occupied by elongated articles into alignment with the predetermined array of the deliverying means; and means for indexing the guiding means about the vertical axis thereof through a predetermined arcuate travel corresponding to the predetermined arcuate increment of the means for moving the engaging means, the improvement comprising:

the means for indexing the guiding means about the vertical axis thereof including means for coupling the guiding means to the interior portion of the container when the top portion of the container is engaged by the engaging means to transmit the turning of the container through the predetermined arcuate increment by the moving means to the guiding means to index the guiding means through the predetermined arcuate travel thereof.

2. Apparatus in accordance with claim 1 in which the means for coupling the guiding means to the container couples the guiding means to the bottom portion of the container.

3. Apparatus in accordance with claim 1 in which the means for coupling the guiding means to the container couples the guiding means to the bottom portion of the container radially inwardly with respect to the side wall portion of the container.

4. Apparatus in accordance with claim 2 in which the means for coupling the guiding means to the bottom portion of the container comprises means for adhering to the surface of the bottom portion of the container.

5. Apparatus in accordance with claim 4 in which the means for adhering to the surface of the bottom portion of the container comprises a suction cup with the concave portion thereof facing downwardly with respect to the guiding means.

6. Apparatus in accordance with claim 4 in which the means for adhering to the surface of the bottom portion of the container comprises a pair of suction cups spaced apart with respect to one another symetrically with respect to the central vertical axis of the guiding means with the concave portion of each of the suction cups facing downwardly with respect to the guiding means.

7. Apparatus in accordance with claim 2 in which the means for coupling the guiding means to the container is disposed beneath the bottom portion of the guiding means.

8. Apparatus in accordance with claim 1 in which the means for guiding the predetermined array of a plurality of elongated articles from the delivering means into a predetermined arrangement within the interior of the container comprises:

a cone-shaped body having the central axis of its cone-shaped coincidental with the vertical axis of the guiding means, the maximum transverse dimension of the cone-shaped body facing downwardly and being less than the minimum transverse dimension of the mouth of the container to enable the plurality of elongated articles to move with respect to the cone-shaped body through the mouth and into the interior of the container to assume the predetermined arrangement within the container, the cone-shaped body having vertically extending indentations on the outer surface thereof corresponding to the predetermined arrangement of the plurality of elongated articles when guided within the interior of the container, the means for pivotally mounting the guiding means about a vertical axis enabling the cone-shaped body to be indexed through the predetermined arcuate travel thereof in correspondence to the rotation of the container through the predetermined arcuate increment.

9. Apparatus in accordance with claim 8 in which the means for pivotally mounting the guide means about its vertical axis comprises a shaft of predetermined length extending along the central axis of the cone-shaped body with the upper end of the shaft supported by the lower end portion of the delivering means.

10. Apparatus in accordance with claim 9 in which the cone-shaped body is adapted to slide vertically with respect to the predetermined length of the shaft and in which the predetermined length of the shaft enables the cone-shaped body to travel through a predetermined vertical distance with respect to the shaft, the cone-shaped body being in an upper vertical position with respect to the shaft when the top portion of the container is at the predetermined level.

11. Apparatus in accordance with claim 10 in which the shaft includes means disposed at the lower end thereof for limiting the downward movement of the cone-shaped body.

12. Apparatus in accordance with claim 11 in which the shaft is stationary and in which the means for limiting the downward movement of the cone-shaped body further comprises:

means for biasing the cone-shaped body to a predetermined circumferential position with respect to the shaft in response to the cone-shaped body engaging the limiting means at the bottommost travel of the cone-shaped body with respect to the shaft, the predetermined circumferential position being that in which indentations of the cone-shaped body are in alignment with the predetermined array of elongated articles when delivered to the mouth of the container by the delivering means.

13. Apparatus in accordance with claim 12 in which the means for biasing the cone-shaped body into the predetermined circumferential position with respect to the shaft comprises a detent mechanism.

14. Apparatus in accordance with claim 12 in which the means for biasing the cone-shaped body into the predetermined circumferential position with respect to the shaft comprises the cone-shaped body having a plurality of downwardly facing recesses disposed in a predetermined circle contiguous to one another at the bottom portion of the cone-shaped body, the number of the plurality of recesses corresponding to and being in alignment with the indentations in the cone-shaped body, and an upwardly facing pin mounted at the lower end of the shaft at a radial distance therefrom corresponding to the radius of the predetermined circle, the pin being adapted to enter one of the plurality of recesses in the cone-shaped body whenever the cone-shaped body moves downwardly in response to the removal of a container from adjacent thereto, whereby the cone-shaped body is placed in the predetermined circumferential position thereof.

15. Apparatus in accordance with claim 14 in which the downwardly facing recesses are conical in form with the apex of the conical form directed toward the upper portion of the cone-shaped body, and in which the upwardly facing pin is of conical form adapted to mate with the conical form of a downwardly facing recess.

16. Apparatus in accordance with claim 9 and further comprising:

means for biasing the cone-shaped body into a predetermined circumferential position with respect to the shaft, the predetermined circumferential position being that in which indentations of the cone-shaped body are in alignment with the predetermined array of elongated articles when delivered to the mouth of the container by the delivering means, the biasing means comprising a pin mounted adjacent the lower end portion of the shaft and extending upwardly toward the cone-shaped body, the cone-shaped body having an arcuate groove extending in a plane substantially perpendicular to the shaft, the upper portion of the pin being disposed in engagement with the groove, one end portion of the groove being engaged by the pin when the cone-shaped body is in the predetermined circumferential position with respect to the shaft, and a spring connected to the cone-shaped body and the shaft for urging the one end portion of the groove therein into engagement with the pin, the spring enabling the indexing means to index the cone-shaped body and to return the cone-shaped body to the predetermined circumferential position.

17. Apparatus in accordance with claim 9 in which the cone-shaped body is coupled to the shaft by means of a clockspring which biases the cone-shaped body to a predetermined circumferential position with respect to the shaft when the coupling means is disengaged.

18. Apparatus in accordance with claim 8 in which the means for guiding the predetermined array of elongated articles includes a cylindrical portion extending downwardly from the periphery of the maximum transverse dimension of the cone-shaped body, the cylindrical portion including additional elongated indentations extending vertically with respect to the cylindrical portion of the cone-shaped body, each additional indentation being aligned with a different one of the indentations of the cone-shaped body and being adapted to receive an elongated article, the additional indentations being adapted to support the elongated articles in a vertically extending direction as the articles are guided by the cone-shaped body.

19. Apparatus in accordance with claim 1 in which the means for moving the engaging means to turn the rotatably supported container engaged therewith about its vertical axis comprises:

a pinion coupled to the engaging means for rotating the engaging means;

a rack in engagement with the pinion; and means for driving the rack through a predetermned distance to rotate the pinion and thereby the engaging means and a container engaged therewith through the predetermined arcuate increment.

20. Apparatus in accordance with claim 19, the means for driving the rack through a predetermined distance comprises a pair of cylinders connected to one another, with the longitudinal axis of each cylinder extending in the direction of the extend of the length of the rack, a piston disposed in each of the cylinders, each piston having a piston rod extending from its cylinder in a direction extending opposite to that of the other piston rod, one piston rod being stationary with respect to the apparatus and the other piston rod being connected to the rack, and means for sequentially applying fluid pressure to each of the cylinders to cause the piston rods to move sequentially with respect to one another to enable the rack to be moved sequentially through the same predetermined distance.

21. Apparatus in accordance with claim 1 wherein a lowering of the means for engaging the container disengages the coupling means.

22. In a method for packing elongated articles into containers having a bottom portion, a side wall portion, and a top portion with a mouth for providing access to the interior of the container, the method having the steps of rotatably supporting a container at a filling station in substantially an upright position for movement about a vertical axis when the top portion of the container is at a predetermined level;

engaging the container at the filling station when the top portion thereof is at the predetermined level;

delivering a plurality of elongated articles at the filling station in a predetermined array to adjacent the mouth of the container when the top portion thereof is at the predetermined level, the elongated articles in the predetermined array having their longitudinal axes extending substantially vertically and spaced apart symetrically with respect to one another to form intervals between the plurality of elongated articles, guiding the delivered predetermined array of a plurality of elongated articles by a guiding element adapted to extend downwardly through the mouth of the container into the interior thereof when the top portion of the container is at the predetermined level, the elongated articles being guided into a predetermined arrangement within the interior of the container in which each elongated article is disposed substantially vertically adjacent to the side wall of the container in circumferential locations corresponding to those of the predetermined array with a space between each elongated article corresponding arcuately to the interval between adjacent elongated articles in the predetermined array, the guiding element being pivotally mounted about a vertical axis substantially corresponding to the vertical rotational axis of a container rotationally supported at the filling station when the top portion of the container is at the predetermined level;

moving the engaged container to turn the rotatably supported container about its vertical axis through a predetermined arcuate increment to position unoccupied circumferential locations of the spaces within the container immediately adjacent circumferential locations within the container occupied by elongated articles into alignment with the predetermined array of the deliverying means; and indexing the guiding element about the vertical axis thereof through a predetermined arcuate travel corresponding to the predetermined arcuate increment of the means for moving the engaging means, the improvement comprising:

the steps of indexing the guiding element about the vertical axis thereof including the step of coupling the guiding element to the interior portion of the container when the top portion of the container is engaged to transmit the turning of the container through the predetermined arcuate increment to the guiding element to index the guiding element through the predetermined arcuate travel thereof.

23. Method in accordance with claim 22 in which the step of coupling the guiding element to the container comprises coupling the guiding element to the bottom portion of the container.

24. Method in accordance with claim 22 in which the step of coupling the guiding element to the interior portion of the container comprises adhering the guiding element to the surface of the bottom portion of the container.

25. Method in accordance with claim 22 in which the guiding element includes vertically extending indentations on the outer surface of the guiding element corresponding to the predetermined arrangement of the plurality of elongated articles when guided within the interior of the container, and further comprising the step of biasing the guiding element to a predetermined circumferential position in which indentations of the guiding element are in alignment with the predetermined array of elongated articles when being delivered to the mouth of the container.

* * * * *